United States Patent [19]

Gana et al.

[11] 4,288,219

[45] Sep. 8, 1981

[54] REFRACTORY INSULATED MEMBER AND METHOD OF INSTALLATION THEREOF IN A REHEAT FURNACE

[75] Inventors: John Gana, Doylestown, Pa.; Dwight L. Torlay, Lawrenceville, N.J.

[73] Assignee: United States Steel Corporation, Pittsburgh, Pa.

[21] Appl. No.: 49,758

[22] Filed: Jun. 18, 1979

[51] Int. Cl.[3] ..... F27D 1/12

[52] U.S. Cl. ..... 432/234; 138/147

[58] Field of Search ..... 432/233, 234; 138/147, 138/149

[56] References Cited

U.S. PATENT DOCUMENTS

| | | | |
|---|---|---|---|
| 2,436,452 | 2/1948 | Schmidt . | |
| 2,482,878 | 9/1949 | Schmidt . | |
| 3,169,754 | 2/1965 | O'Reilly . | |
| 3,329,414 | 7/1967 | Greaney | 432/234 |
| 3,781,167 | 12/1973 | Ahonen | 432/234 |
| 4,182,609 | 1/1980 | Hovis et al. | 432/234 |

OTHER PUBLICATIONS

J. E. Foldessy "Precast Refractory Covering for Reheating Furnace Skid Rails"-Disclosure #66-2, Design Engineering (Chicago)-Dec. 1966.

*Primary Examiner*—Charles A. Ruehl

*Attorney, Agent, or Firm*—William F. Riesmeyer, III

[57] ABSTRACT

A reheat furnace work supporting member has a full length support bar protruding outwardly from precise locations on each of its opposite sides. The support bars extend the full length of the portion of the member which is to be insulated. A sectioned refractory barrier is suspended on the member by metal hangers which rest on the support bars. A method is also disclosed which includes providing a horizontal member having support bars positioned accurately on its opposite sides by preparation of the member outside a reheat furnace, then installing the member in the furnace where a refractory barrier having downwardly extending metal hangers can be attached quickly and easily at proper locations anywhere along the length of the member without requiring welding inside the furnace.

2 Claims, 4 Drawing Figures

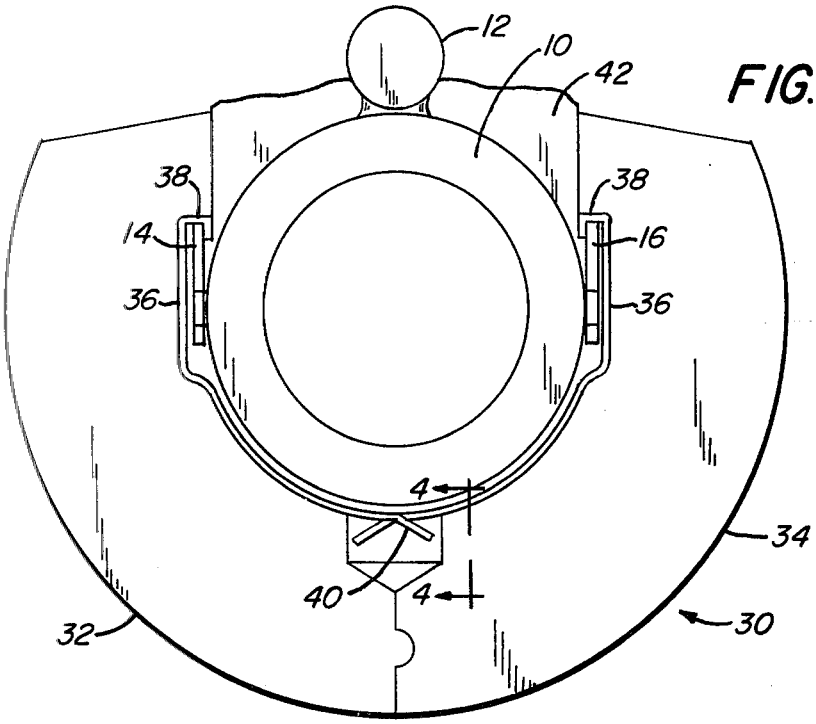
FIG. 1
FIG. 2
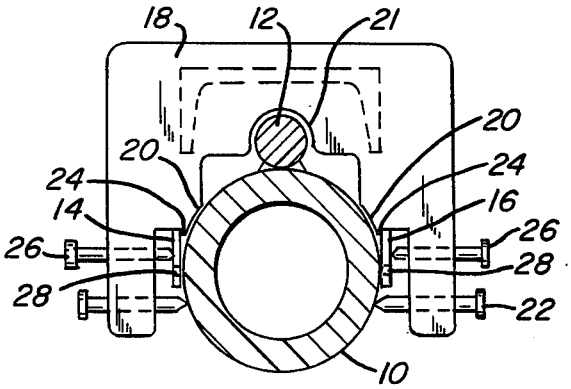
FIG. 4
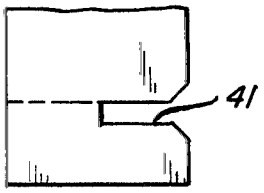
FIG. 3
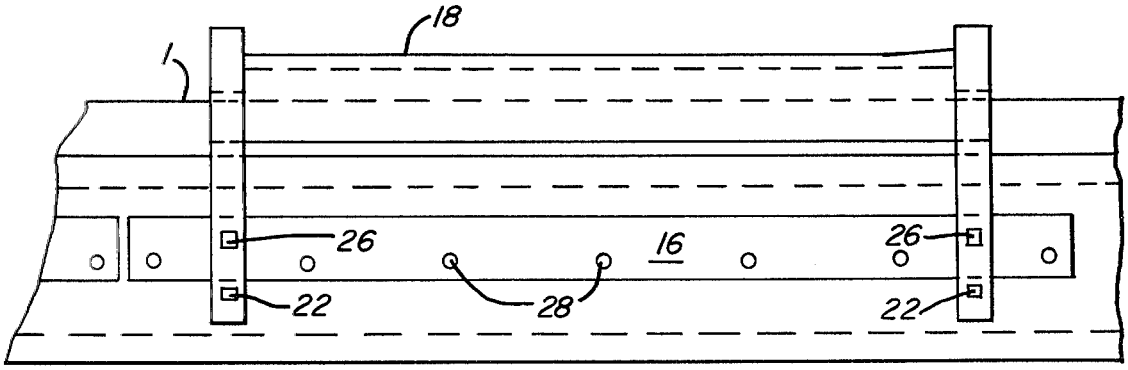

REFRACTORY INSULATED MEMBER AND METHOD OF INSTALLATION THEREOF IN A REHEAT FURNACE

BACKGROUND OF THE INVENTION

The invention relates to a method for installing a horizontal member in a reheat furnace and attaching a refractory barrier thereto, and to such a horizontal refractory insulated member.

In the past, water cooled skid pipes in slab or billet reheating furnaces have been installed by securing them in proper position in the furnace during a shutdown when the furnace is cool. Many types of refractory insulation are commercially available for attachment to the pipes to reduce energy loss from the furnace. In one type, shown in Schmidt, U.S. Pat. Nos. 2,482,878, Schmidt, 2,436,452 and O'Reilly 3,169,754, metal lugs are welded onto the pipe at desired locations and then refractory sections are suspended from the lugs either by metal hangers or by the refractory itself. In another type, such as shown in Bloom U.S. Pat. No. 2,693,352 and Brungraber U.S. Pat. No. 3,647,194 the refractory sections are bonded to metal mesh which is welded to the pipe. In either case welding in the furnace is a disadvantage because it is time consuming and extends the length of furnace shutdown necessary for installing the skids. Also, it is difficult to control quality when welding stainless steel materials. Welders have a tendency to restrike the electrode arc successively causing carbon pickup which gives brittle welds. Thus the service life of the insulation will be shortened. Greaney, U.S. Pat. No. 3,329,414 shows a skid pipe having horizontal lugs comprised of sections extending substantially the full length of the pipe. However, the sections have substantial gaps left between their adjacent ends so that compressible washers may be inserted between tiles laid on the lugs. Thus, the lugs must be installed on the pipe after the pipe is located in the furnace on its supports. The patent also shows tiles having notches for fitting over the lugs. This makes the tiles subject to cracking, particularly when subjected to vibration or flexure of the pipe in service.

Accordingly, it is an object of this invention to provide an improved method of installing insulated work supporting members in a reheat furnace which requires less time and provides a refractory barrier that remains attached to the pipe for longer periods.

It is also an object of this invention to provide a refractory insulated work supporting member in which the refractory barrier gives a longer service life.

It is another object of this invention to provide a refractory insulated member in which damaged refractory barrier sections may be replaced without welding.

SUMMARY OF THE INVENTION

According to this invention an improved method is provided for installing work supporting members in a reheat furnace, and for attaching a refractory barrier to the member. The method includes providing a member having at least one full length support bar accurately positioned on each of its opposite sides. The member is then installed into position on a structural supporting means in the reheat furnace and a sectional refractory barrier is suspended from the support bars by metal hanger means secured to each of the barrier sections. The method completely eliminates the need for welding inside the reheat furnace, thus saving time during installation and providing longer refractory insulation service life.

Also according to the invention, a refractory insulated work supporting member is provided which has at least one full length support bar secured to its opposite sides and protruding outwardly therefrom at precise locations. A refractory barrier is provided for covering at least a portion of the periphery of the member and is made up of at least two mateable peripheral sections. A metal hanger means secured to each peripheral section of the barrier rests on the support bar for suspending the barrier on the bars. Thus, the barrier is easily and quickly installed without welding.

BRIEF DESCRIPTION OF THE DRAWINGS

Other objects, features and advantages of the invention will be more apparent from the following detailed description when taken in conjunction with the appended claims and drawings in which:

FIG. 1 is a cross section of a horizontal reheat furnace skid pipe.

FIG. 2 is an end view of a jig for locating support bars with respect to the member.

FIG. 3 is a side elevation view of the apparatus of FIG. 2.

FIG. 4 is a view taken at 4—4 of FIG. 1 showing the lower end of the metal hanger.

DESCRIPTION OF THE PREFERRED EMBODIMENT

For purposes of the description we will refer to a horizontal skid for use in a slab or billet steel reheating furnace. The invention is applicable however, to either substantially horizontal skids on which the refractory barrier covers only a portion of the periphery of the skid pipe, or other horizontal or vertical supports. For purposes of the claims the term work supporting member includes all such applications. According to the invention, we prepare a skid pipe 10 (FIG. 1) outside the reheat furnace before it is installed therein. We attach a conventional metal runner 12 to the top surface of the pipe on which the slabs or billets are to ride. Support bars 14, 16 are then welded to the pipe. The support bars extend the full length of the portion of the pipe which is to be insulated. Each support bar may include sectional lengths substantially abutting each other in end-to-end relation. We use a jig 18 (FIGS. 2 and 3) to attach the support bars at precise locations on the pipe periphery. The jig has shoulders 20 and slot 21 for locating the jig itself accurately on the pipe. Set screws 22 engage the pipe to hold the jig in place. The support bars are then inserted in the jig and rest on jig guide surfaces 24 so as to be precisely positioned on the pipe periphery. Set screws 26 engage the support bars to hold them in position. Welds are made at holes 28 spaced along the length of the support bars. We prefer to use a mild steel pipe and mild steel support bars to insure that good strong welds are made. The support bars are preferably located on the upper one half portion of the pipe periphery and face upwardly therefrom, most preferably in a vertical direction.

After preparing the pipe as above described, it is installed in the reheat furnace on a conventional structural support means (not shown). The full length support bars allow the refractory barrier to be attached at any location along the length of the pipe in between the structural support means, thus permitting rapid installation of the barrier in the furnace. The barrier 30 preferably is an alumina cast refractory which includes two mateable part peripheral sections 32, 34. A metal hanger 36 is bonded to the interior surface of each refractory barrier section. We prefer to use stainless steel hangers and particularly those having high heat and oxidation resistance such as the AISI 300 series, and more preferably Type 310 grade. The upper ends 38 of the hangers have curved portions which simply rest on the support bars. The lower ends 40 of the hangers have mateable notches 41 (FIG. 4) of conventional design which permit attachment of the barrier sections at their lower ends by installing them on the pipe and sliding them together in the direction of the pipe axis. Such an attachment means is available from C-E Refractories, Inc. We then ram refractory material 42 on the top portion of the pipe not covered by the barrier to protect the support bars and hangers from heat and oxidation. The design of this invention also permits faster repairs when any of the barrier sections become damaged. Removal and reinstallation of support bars is not required. We simply remove the refractory and hang new sections from the support bars which are already in proper position. This permits us to repair the insulation during short furnace shutdowns such as weekend cleanouts which occur more frequently than shutdowns for a complete furnace rebuild. Thus, we have found that it is easier to keep the work support member insulated which results in considerable fuel and energy savings due to reduced firing required in our furnaces.

We claim:

1. In a horizontal work support member for a reheat furnace, said member including an elongated metal pipe, a refractory barrier comprising a plurality of mateable pairs of sections for covering at least a portion of the periphery of said pipe, support means for said sections secured exteriorly on each of two opposite sides of an upper half of the cross section of said pipe, each barrier section having a metal hanger secured to and extending along the inner surface thereof from an upper end engageable with said support means to a lower end connectable to the corresponding lower end of the hanger means of the opposite section in the pair, the improvement in said member which comprises:

said support means being a plurality of elongated metal bars secured lengthwise in prescribed position on the periphery of said pipe on each of said opposite sides thereof, said bars being aligned mateably in close adjoining end-to-end relation and of substantially solid cross section, said bars facing upwardly and having a portion of the cross section thereof remote from the pipe periphery extending therefrom a uniform distance along the length of said pipe, the upper end of said hanger means having a fixed shape substantially conforming to the shape of said remote portion of the bars protruding from said pipe so as to fit closely over the outer periphery of said bars at any desired location along the length thereof.

2. The apparatus of claim 1 wherein said bars are of rectangular cross section in which said cross section extends longitudinally in a tangential direction vertically from said pipe.

* * * * *